United States Patent [19]

Schlage

[11] 3,967,481

[45] July 6, 1976

[54] DETECTOR CYLINDER

[75] Inventor: Ernest L. Schlage, San Mateo, Calif.

[73] Assignee: Schlage Lock Company, San Francisco, Calif.

[22] Filed: Dec. 30, 1974

[21] Appl. No.: 537,560

[52] U.S. Cl. ..... 70/431; 70/419; 70/378

[51] Int. Cl.[2] ..... E05B 17/00

[58] Field of Search ..... 70/431, 432, 433, 434, 70/447, 378, 416, 419, 421; 200/61.66, 42 R, 44; 340/274

[56] References Cited

UNITED STATES PATENTS

| | | | |
|---|---|---|---|
| 2,057,301 | 10/1936 | Gdokow | 200/61.66 |
| 2,095,819 | 10/1937 | Lefebure | 200/61.66 |
| 3,724,245 | 4/1973 | Kitchen | 200/44 |
| 3,797,004 | 3/1974 | Muessel | 340/274 |
| 3,801,775 | 4/1974 | Schlage | 200/44 |

*Primary Examiner*—Robert L. Wolfe
*Attorney, Agent, or Firm*—Lothrop & West

[57] ABSTRACT

A detector cylinder is used in a door lock and includes a cylinder body having a plug bore therein and having one or more pin bores in the body opening into the plug bore. A plug is rotatable in the plug bore and has a keyway and one or more pin openings communicating with the keyway and in one rotated position of the plug also communicating with the pin bore or bores. There are one or more first pins slidable in the pin bores and one or more second pins slidable in the pin openings. A spring or springs are disposed to urge the pins towards the keyway. An electrically conducting contact is disposed on the cylinder body in position to be abutted by a first pin in one of the longitudinal locations of the first pin. There is an electrical circuit that is completed when the first pin abuts the contact. The circuit may include an alarm and a switch for preventing an alarm.

10 Claims, 10 Drawing Figures

DETECTOR CYLINDER

In the provision of locks such as door locks for buildings and the like it is customary to have a cylinder mechanism including a cylinder body having a plug rotatable therein. The plug has a keyway into which a proper key can be introduced. The cylinder body has pin bores in it extending into the plug bore and containing first pins that are slidable in the bores and are urged toward the keyway by springs. Also there are provided pin openings in the plug communicating with the keyway and in one rotated position of the plug also communicating with the pin bores. The mechanism can readily be operated by a proper key introduced into the keyway and setting the first pins and the second pins in appropriate relationship with their abutting faces coinciding with the shear line of the plug in the cylinder body. There are instances in which the attempted operation of the lock either by a proper key or other means such as lock picks should be evidenced, by an alarm or other informational output.

It is therefore an object of the invention to provide a detector cylinder mechanism which will afford a prompt alarm when an attempt is made to operate the pin mechanism in the cylinder body.

Another object of the invention is to provide various configurations of an operating warning structure that can readily be adapted to locks of a standard configuration.

Another object of the invention is to provide a warning mechanism that is energized by a normal or an improper actuation of the lock.

Another object of the invention is to provide various ways of completing an electric information or warning circuit effective upon an attempted actuation of a lock.

A further object of the invention is in general to provide an improved information or warning device for locks.

Other objects, together with the foregoing, are attained in the embodiment of the invention described in the accompanying description and illustrated in the accompanying drawings, in which.

Figure 4:
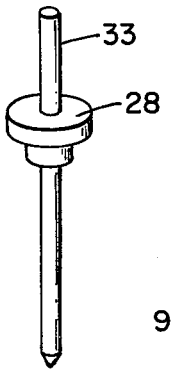
FIG. 4 is an isometric perspective view of one form of contact and insulator structure as illustrated in FIG. 1.

While a device pursuant to the present arrangement can be embodied in numerous different ways, it has successfully been incorporated as shown herein. In this device, there is provided a cylinder body 6 of the customary kind fabricated of metal and having therein a plug bore 7 of generally circular-cylindrical configuration symmetrical about an axis 8. The cylinder body is provided with one or more pin bores 9, usually circular-cylindrical and having their own axes parallel to each other and also normal to the axis 8. Each of the pin bores intersects the plug bore 7. Within each of the bores 9 there is provided a first, metal pin 11. This is movable longitudinally or axially of the pin bore toward and away from the plug bore 7. The first pins 11 are impelled in the direction of the plug bore 7 by helical springs 12 in the respective bores and abutting the upper end of the cylinder body.

Disposed in the plug bore 7 is a rotatable plug 14 of the usual construction having an enlarged flange 16 at one end and a removable screw cap 17 at the other to hold the plug rotatably in place. In the plug is a keyway 19 of any appropriate configuration to receive a key 20 of the customary sort. The plug 14 also is provided with a number of pin openings 21 communicating with the keyway 19 and, in one position of the plug 14 in the cylinder body, also communicating with and in effect extending the adjacent pin bores 9. Located in the pin openings 21 are second, metal pins 22 adapted, like the first pins 11, to slide longitudinally in the pin bores 9 and the pin openings 21 under the influence of the springs 12 and of the motive force of the key 20.

When the key 20 is absent from the keyway 19, it is possible to insert picking tools into the keyway and to lift the pins 22 and 11 in order to operate the lock to gain access to the interior.

Figure 1:
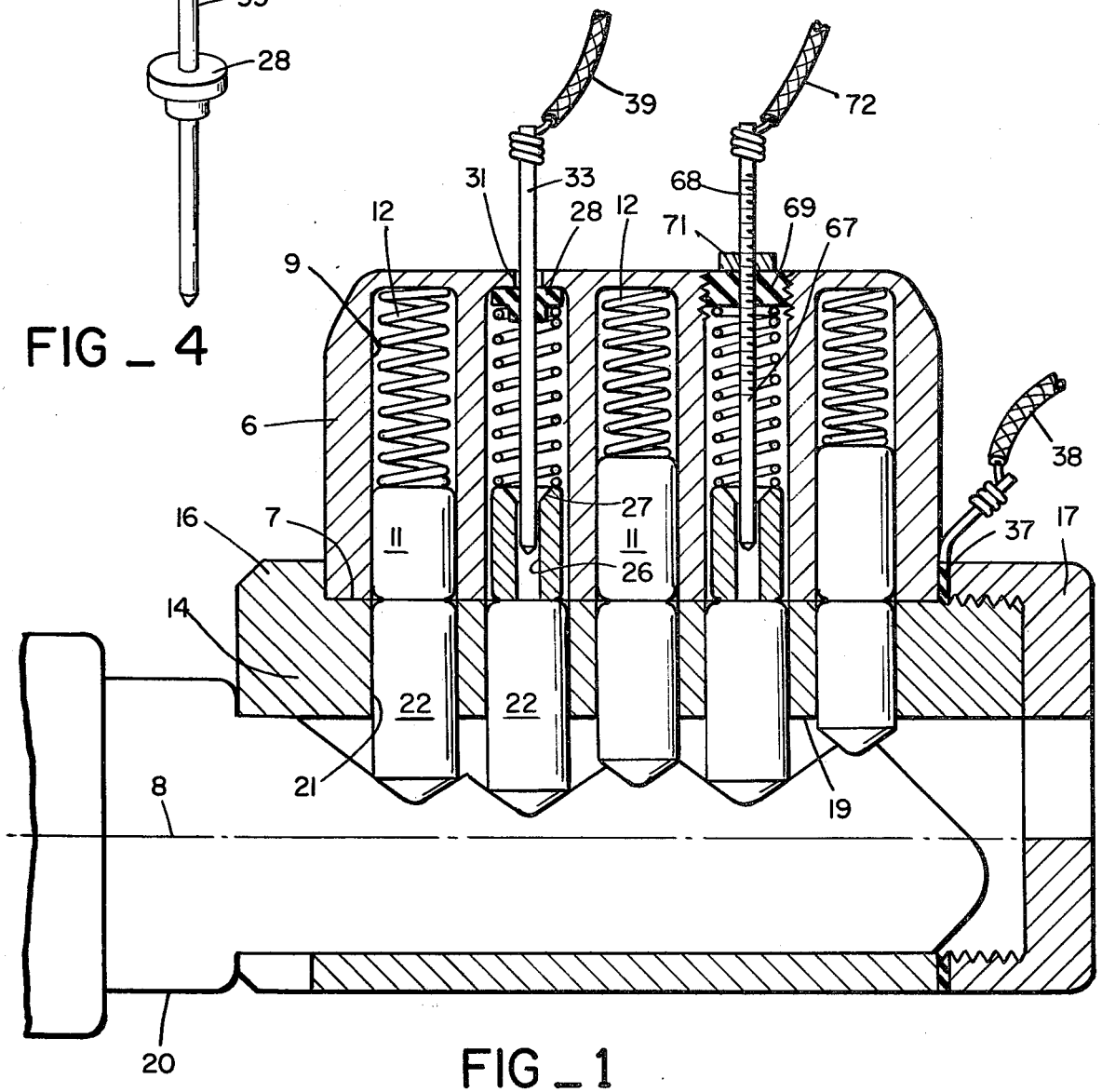
FIG. 1 is a cross-section on a vertical axial plane through a lock mechanism with a key inserted and having examples of several forms of detector mechanism shown therein.

Particularly in accordance with the invention, to inhibit such picking and to respond to authorized use of the lock, there is provided an alarm or output mechanism actuated electrically. For example, at least one of the pins 11, as especially shown in FIG. 1, is not solid, as is customarily the case, but rather is made tubular to afford a central, axial passageway 26. The passageway is generally circular-cylindrical but is preferably provided with a conical entrance 27 flaring upwardly. Adequate material remains to form a good seat for the related spring 12.

Since the cylinder body 6 is metal and a good electrical conductor, there is provided an insulator 28 of non-conducting material positioned within the bore 9 and abutting the body 6 to surround an opening 31 therein. The insulator is partly positioned by spring pressure and is arranged so that the insulator also acts as a guide for a rod 33 extending well into the interior of the cylinder body from an exterior point. The rod 33 is of conducting material but is not electrically connected to the cylinder body by reason of the much larger size of the opening 31 and by reason of the insulating washer 28.

The rod extends axially of the pin bore 9 and can be axially adjusted and held frictionally in adjusted position so that it normally extends into the interior of the passageway 26, substantially as shown in FIG. 1, although the rod may be lifted or lowered to occupy other interior positions.

It is particularly important that the clearance between the rod 33 and the inner wall of the pin 11 defining the passageway 26 be somewhat less than the clearance between the outside of the pin 11 and the interior of the pin bore 9. These clearances are both small and cannot be accurately shown to scale in the drawing. Because of this relationship of the clearances, the pin 11 can not only readily slide up and down in the pin bore, but also can move transversely or laterally away from the bore wall far enough to cock or shift or tilt into abutment simultaneously with the rod 33 and with the cylinder body 6 if an appropriate force is exerted on the pin.

In order to establish an electrical circuit, later to be described, between the rod 33 and the related pin 11, there is provided an electrically conducting washer 37 interposed between the cylinder body 6 and the securing cap 17, the clearance relationship being such that the washer 37 conducts well with the body 6 even though there is relative rotation between the cap 17 and the body. The washer 37 has a conductor 38 included in the electrical circuit mentioned, while the rod 33 also has a conductor 39 included in such circuit.

In the operation of the structure as so far described, when the key 20 is inserted into the keyway 19, or when a picking tool is introduced into the keyway and either means engages and lifts the pin 22, in the second order; for example, the pin 11 is also lifted. Because such pin 11 is in very close physical relationship with the lower end of the rod 33, although normally out of electrical contact therewith and since there is some clearance between the outside of that pin and its related guiding pin bore 9, the slightest lifting of the pin 11 causes it to tip, or move transversely or laterally sufficiently so that at least momentarily it electrically bridges the cylinder body 6 and the rod 33. That causes completion of a circuit involving the conductors 38 and 39.

Figure 9:
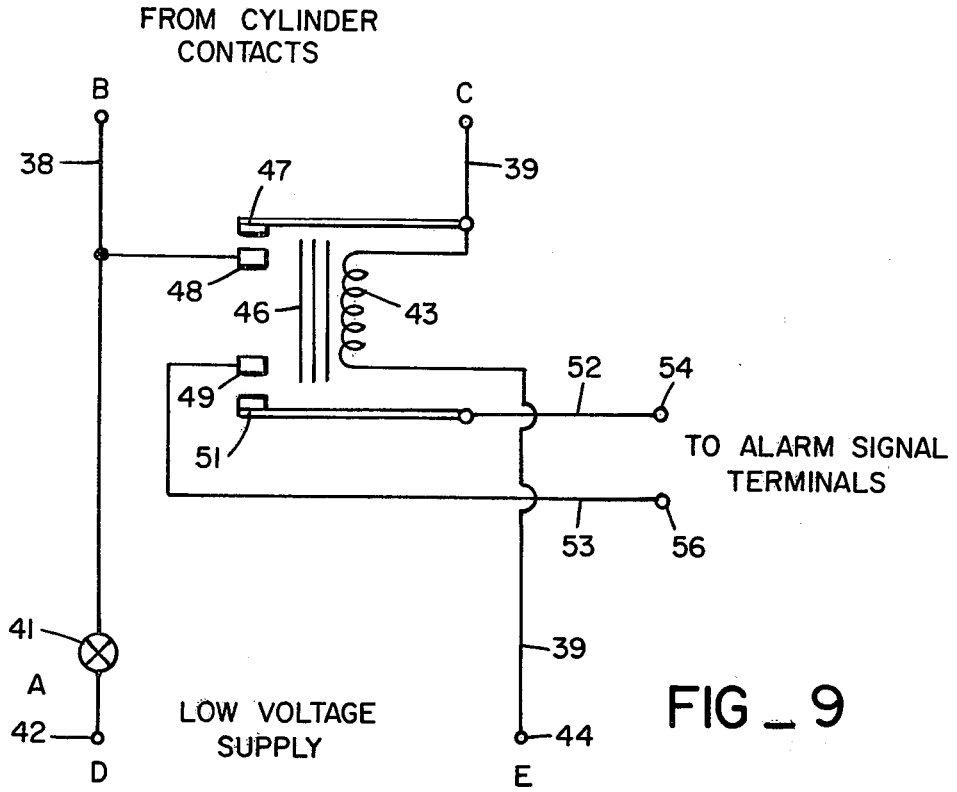
FIG. 9 is a circuit diagram showing the important parts of an output or alarm circuit incorporating the mechanism of the present invention.

In one form of circuitry for use with this mechanism, as shown in FIG. 9, the conductor 38 extends to a junction B and continues through an auxiliary switch 41 to the D terminal 42 of a battery or other low voltage source of electricity. Similarly, the conductor 39 extends to a junction C and continues through a magnet coil 43 and to the E junction 44 which is the other side of the battery or electrical supply at low voltage. The switch 41 is an auxiliary circuit controller. It can be opened either by opening the door in which the lock mechanism is installed or opened manually on the inside of the door in order to interrupt the electrical circuit. The switch 41 is thus in series with what in effect is a switch formed by the pin 11, the body 6 and the rod 33.

The coil 43 is part of a relay having a core 46 and when energized is effective to close holding contacts 47 and 48 in a shunt low voltage circuit and also to close main contacts 49 and 51. These are in a second, low voltage circuit represented by conductors 52 and 53 having junctions 54 and 56 connected to any suitable sort of indicator or alarm, such as a recorder, a light or a bell or the like.

In the operation of this mechanism, it is considered that the switch 41 is normally closed and the circuits are otherwise complete except for the normally open contacts 47 and 48 as well as the normally open contacts 49 and 51 and, of course, the customary gap between the pin 11 and the rod 33. During the initiation of any unlocking operation by key or by picking tool, as soon as the position of the pin 11 is disturbed a momentary bridging contact, at least, is made by the pin between the cylinder body 6 and the rod 33. There is at least a momentary impulse in the electric circuit energizing the coil 43. This immediately closes the contacts 47 and 48 and maintains the low voltage circuit closed through the coil 43. This continues what otherwise might be but an instantaneous circuit closure. At the same time, the contacts 49 and 51 are urged and held closed. Whatever output device is supplied with energy and is controlled by the contacts 49 and 51 is set off. Thus, as soon as any lock actuation is attempted, the alarm is set off.

A possible difficulty with this arrangement as so far described is that both the operation of a proper key 20 in the keyway and a picking operation cause a similar abutment between the pin 11 and the rod 33 and set off the alarm. In some arrangements, an immediate alarm is desirable but in other cases an immediate alarm is not wanted. It is, therefore, preferably arranged that there be a delay of, say, 5 seconds or so before the alarm sounds. The alarm circuit joined to the terminals 54 and 56 can include a standard, fixed or variable delay device (not shown). Then, after the contacts 47 and 48 are initially closed and held closed by the coil 43, the user has a delay time, say, 5 seconds to open the door before the lock actuation is noted. Door opening can automatically open the switch 41 to preclude an alarm. The switch 41 alternatively can be on the interior of the enclosure in position manually to be opened by the entrant so that the alarm is decoupled. In this way an entry followed by opening of the switch 41 does not cause any alarm, whereas a picking attempt which takes more than the delay time (say, five seconds) does cause an alarm.

Figure 10:
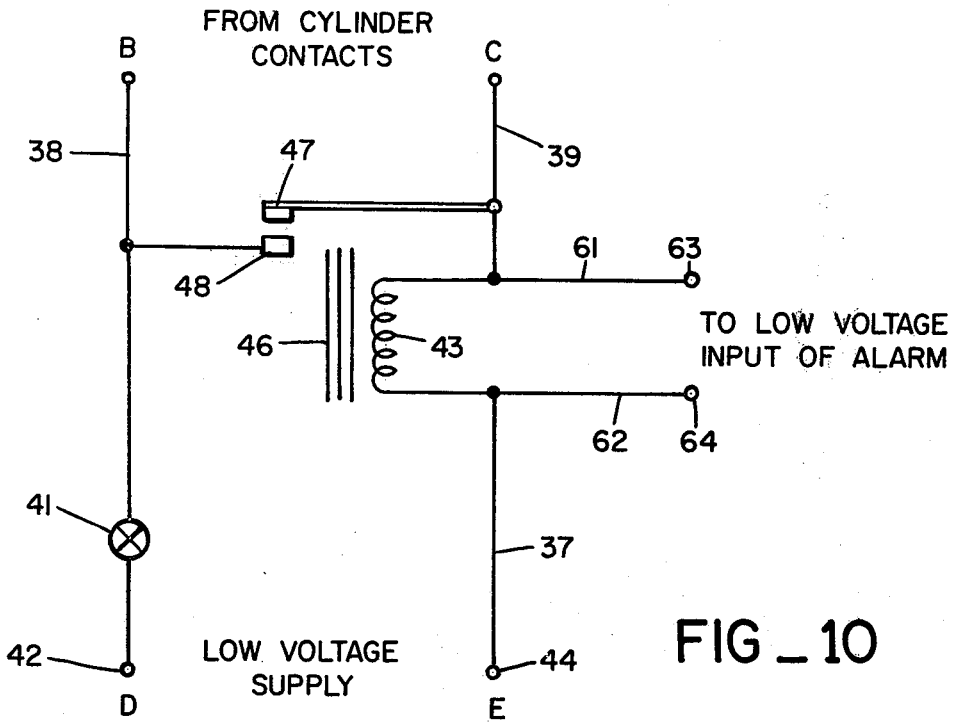
FIG. 10 is a circuit diagram showing a modified form of circuit.

As an alternative circuit, as shown in FIG. 10, the conductors 38 and 39 from the junctions B and C are as before and are effective upon momentary rod-pin contact to energize the relay 46 to afford long closure of the contacts 47 and 48 so that the relay 46 acts as a holding device, the connection to the low voltage supply between the D and E terminals 42 and 44 being then complete. There is also an output through conductors 61 and 62 to junctions 63 and 64 joined through a delay device (not shown) to the alarm mechanism. In this instance, the low voltage is thus made available to the alarm, which operates unless and until it is shut off manually by operation of the interior switch 41 or by opening the door in the event the switch 41 is actuated by door opening. In the use of either circuit, there is an alarm whenever there is a pin-moving operation in the keyway 19. In some cases, without a delay device, the alarm can be immediately given when the pin is disturbed, the relay serving to maintain the circuit after a momentary closure. In this instance the "alarm" may simply be a silent indication to show lock actuation.

There may be variations of this fundamental arrangement. One of them is as shown in FIG. 1, in which the mechanism is substantially as previously described, except that the rod 67 in the fourth order of the key mechanism instead of being frictionally held in place is provided with threads 68. The rod can be turned into and out of an interiorly threaded insulating plug 69 positioned in the cylinder body 6. The rod or probe 67 is then moved axially up or down at the operator's preference and is held in adjusted position by tightening a lock nut 71. There is a conductor 72 forming a connection to the junction point C exactly as does the conductor 39. The operation of the structure is the same as previously described.

Figure 2:
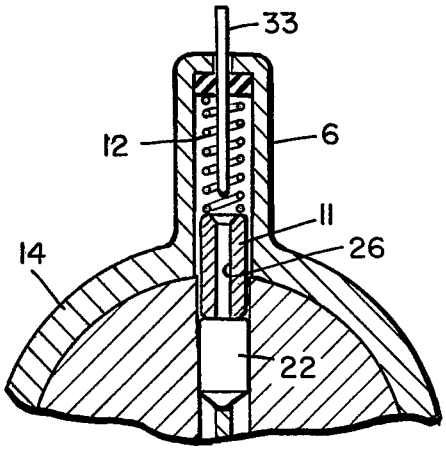
FIG. 2 is a partial cross-section in diagrammatic form of parts of the detector cylinder mechanism in position but without a key in place.
Figure 3:
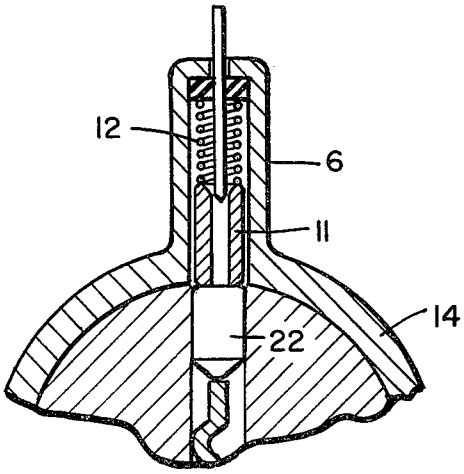
FIG. 3 is a view comparable to FIG. 2 but showing the parts in position and with a key in place.

As shown particularly in FIGS. 2 and 3, with the adjustable rod 33 or 67, the position of the rod with respect to the top pin can be arranged so that the top pin is out of the range of the rod whenever the keyway is empty, although the rod can be contacted by the lifted top pin during a keyway operation. As shown in FIG. 2, however, the arrangement is one in which the top pin can contact the rod when the key or a pick is inserted, thus energizing the alarm circuit and starting the period of delay for alarm actuation at any pin-lift point selected by the user.

Figure 5:
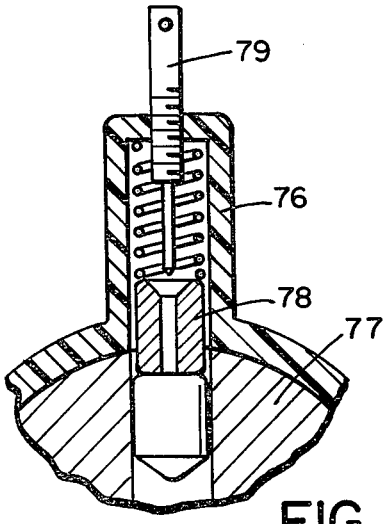
FIG. 5 is a cross-section comparable to FIG. 2, for example, but showing a different form of contact mechanism.

As a variation on the theme, it is not necessary that the cylinder body 6 be of conducting material. As particularly shown in FIG. 5, the cylinder body 76 is of a non-conducting plastic material which, however, serves as a housing for an electrically conducting plug 77, electrically conducting pins such as the pin 78, and an electrically conducting rod 79, provided with a connection to a conductor as previously described. Here also, the rod 79 is adjustable by screw threads into any selected axial position. In this instance the electric circuit is completed not through the body 6 but rather through the plug 77, the pin 78 and the rod 79.

Figure 6:
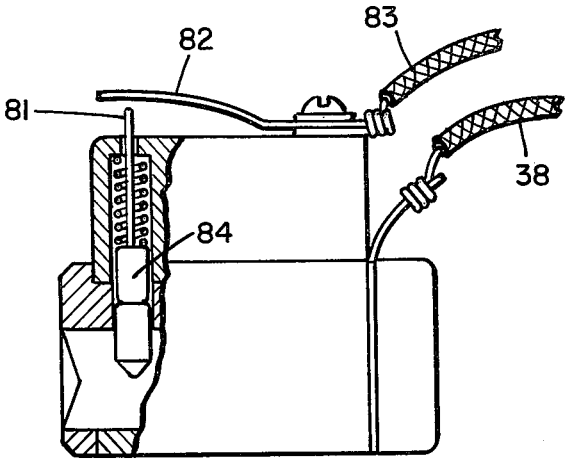
FIG. 6 is a view somewhat comparable to FIG. 1, portions being in elevation and other portions being broken away, showing a modified form of detector cylinder structure pursuant to the invention.

There is a further variation, as illustrated in FIG. 6. In this instance the rod 81 is not connected in an electric circuit until it is lifted through a predetermined amount, an amount sufficient so that the end of the conducting rod contacts a spring finger 82 having a connection to a conductor 83 comparable to the conductors 39 and 72. In this instance, it is not so much the wall and rod contact of the pin 84 that is consequential as it is the lifting of the pin sufficiently to make the central rod 81 abut the finger 82. This mechanism is perhaps not quite as sensitive as those previously described, but nevertheless still operates by movement of the pin 84 to complete an appropriate electrical alarm circuit.

Figure 7:
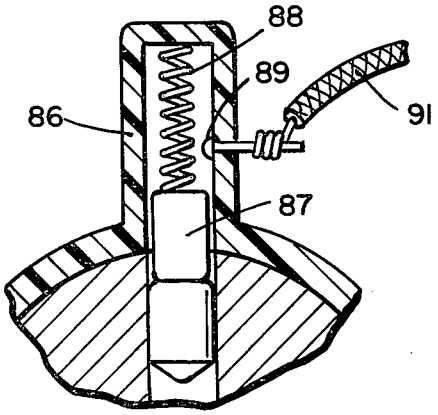
FIG. 7 is a view comparable to FIG. 5 but showing a modified form of contact arrangement.

Again, as shown in FIG. 7, the mechanism can incorporate a suitable non-conducting cylinder body 86 with the customary first pin 87 abutted by a spring 88 but liftable by a proper key or by picking tools. However, when the pin 87 is lifted substantially, it comes into abutment with a wall contact 89 joined to a conductor 91 comparable to the conductor 39. In this instance, again, the action takes place not so much by a cocking or twisting of the pin 87 as it does by a lifting of such pin far enough to abut the contact 89. The ensuing events are as previously described.

Figure 8:
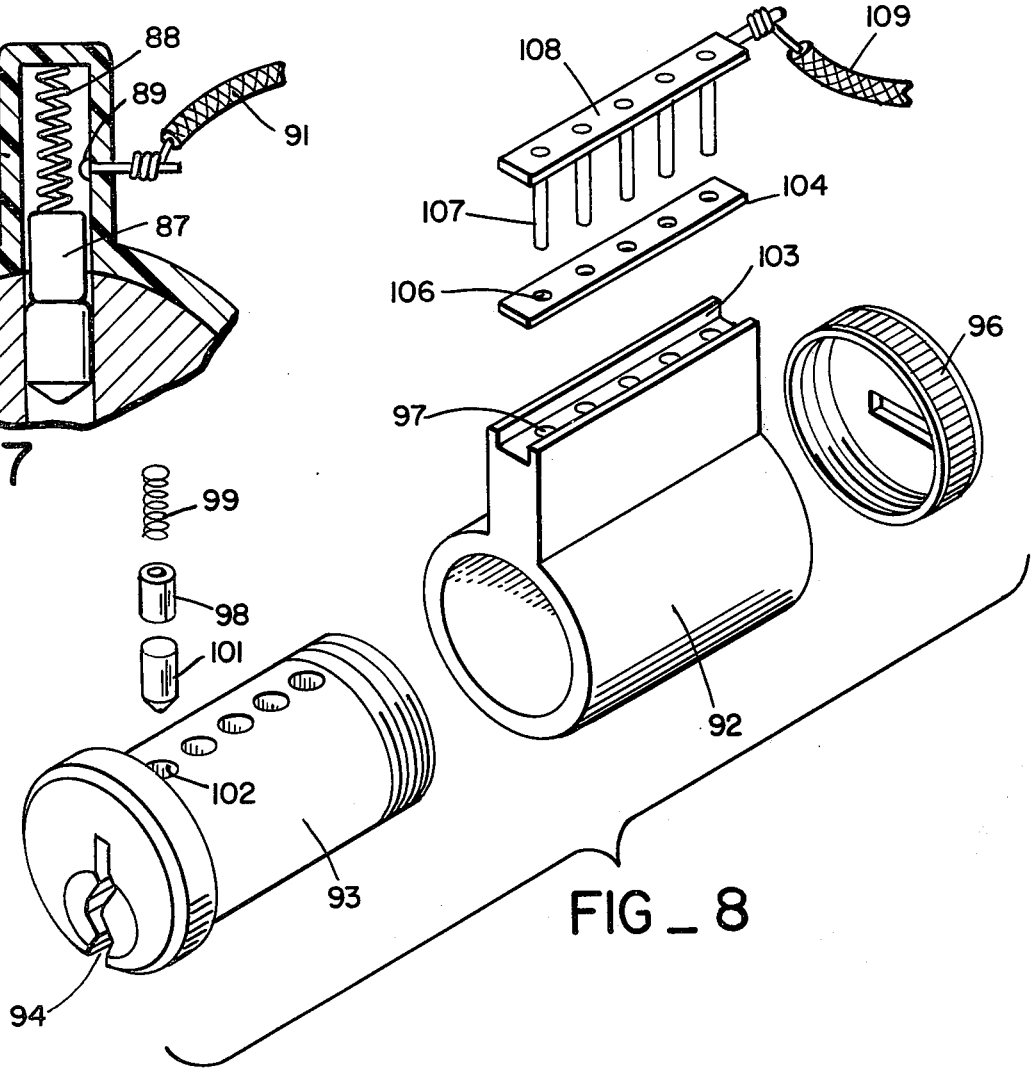
FIG. 8 is an exploded view showing a still further modified form of detector cylinder construction.

As shown in exploded fashion in FIG. 8, the mechanism is generally as previously described in that there is afforded a cylinder body 92 in which a conducting cylinder plug 93 is rotatable. The cylinder plug has a keyway 94 for the reception of an appropriate key. It likewise has an arrangement as in FIG. 1 including a retaining cap 96 to hold it in axial position. The cylinder body 92 has pin bores 97 therein in which there are tubular pins 98 urged into position by springs 99. Second pins 101 operate in pin passages 102 in the plug 93 which in one position of the plug are in alignment with the bores 97. Preferably, the body 92 is of electrically non-conducting material and is made with a top channel 103 therein into which is inserted an insulating plate 104 to serve as an abutment for the springs and having registering openings 106 therein. The openings receive central rods 107, all of conducting material and mounted on a conducting plate 108 joined to a lead 109 comparable to the conductor 39. The plug 93 is connected into the other side of the circuit by a means similar to that shown in FIG. 1; namely, a washer 37 contacting the plug and a conductor 38 (not shown).

In this mechanism, when the key is inserted or when picking tools are utilized and the first pins 98 are tipped or cocked or lifted, they make at least momentary contact with the respective ones of the rods 107 and momentarily close the circuit, thus operating the relay to maintain closure of the circuit and to energize the alarm after a short delay unless the user, gaining access to a switch such as the switch 41 within the enclosure, turns the alarm off before it can become energized, or unless the opening of the door similarly deenergizes the circuit so that there is no alarm. Thus there is afforded access without alarm to an individual provided he turns the alarm mechanism off by opening the door or by switching off manually, but an alarm is sounded very promptly after the initiation of an unlocking operation.

What is claimed is:

1. A detector cylinder comprising a cylinder body having a plug bore therein extending along an axis, means defining a pin bore in said body opening into said plug bore, a plug rotatable in said plug bore, means defining a keyway in said plug, means defining a pin opening in said plug communicating with said keyway and in one rotated position of said plug in said plug bore registering with said pin bore, a first pin slidable in said pin bore and said pin opening, a second pin laterally shiftable and slidable in said pin bore and said pin opening, a spring engaging said second pin and urging said second pin and said first pin toward said plug bore, an electrical contact in said pin bore and spaced laterally of said second pin, and means for establishing an electrical circuit through said electrical contact and said second pin when said second pin is moved laterally in said pin bore into abutment with said electrical contact.

2. A device as in claim 1 in which said second pin is a tubular electrical conductor and defines an axial passageway, and said electrical contact is a fixed rod receivable in said passageway and approximately aligned axially with said second pin.

3. A device as in claim 2 in which said rod is mounted in and extends from said cylinder body.

4. A device as in claim 2 in which said second pin has lateral clearance in said plug body sufficient to allow movement of said second pin laterally into abutment with said rod.

5. A device as in claim 2 in which said second pin and said rod are out of electrical contact except when laterally touching each other.

6. A device as in claim 2 in which an electrical insulator interposed between and engaging both said rod and said plug body holds said rod against lateral movement of said rod in said body.

7. A device as in claim 2 in which said rod is longitudinally adjustable in said plug body.

8. A device as in claim 4 in which said lateral clearance between said pin and said plug body is greater than the clearance between said rod and the inner wall of said pin.

9. A device as in claim 1 in which said cylinder body is of electrically conducting material, said electrical contact is electrically insulated from said cylinder body, and said second pin is an electrical conductor movable into electrical conduction with said cylinder body and said electrical contact.

10. A device as in claim 1 in which said cylinder body is of electrically insulating material, said electrical contact is of electrically conducting material, and said second pin is of electrically conducting material.

* * * * *

UNITED STATES PATENT OFFICE

CERTIFICATE OF CORRECTION

Patent No. 3,967,481 Dated July 6, 1976

Inventor(s) Ernest L. Schlage

It is certified that error appears in the above-identified patent and that said Letters Patent are hereby corrected as shown below:

On the Title Page, Item [75] "San Mateo" should read -- Burlingame --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*